US006946607B2

(12) United States Patent
Roberts

(10) Patent No.: US 6,946,607 B2
(45) Date of Patent: Sep. 20, 2005

(54) RESISTANCE ASSEMBLY FOR HOOKSTICK OPERATED SWITCHING ASSEMBLY

(75) Inventor: Gerald B. Roberts, Monroe, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/732,816

(22) Filed: Dec. 11, 2003

(65) Prior Publication Data

US 2004/0135667 A1 Jul. 15, 2004

Related U.S. Application Data

(60) Provisional application No. 60/432,646, filed on Dec. 12, 2002.

(51) Int. Cl.[7] ..... H01H 31/00
(52) U.S. Cl. ..... 200/48 R; 200/48 A; 218/14
(58) Field of Search ..... 200/48 A, 48 SB, 200/48 R, 48 CB, 48 KB, 49; 218/2, 7, 9, 12, 14, 20, 21, 153, 154

(56) References Cited

U.S. PATENT DOCUMENTS

| | | | | |
|---|---|---|---|---|
| 1,693,608 | A | | 12/1928 | Lippert |
| 1,712,856 | A | | 5/1929 | Thulien |
| 2,710,897 | A | | 6/1955 | Lindell |
| 3,165,601 | A | | 1/1965 | Bohler |
| 3,316,372 | A | | 4/1967 | Bridges |
| 3,499,129 | A | | 3/1970 | Hulteen |
| 3,624,592 | A | | 11/1971 | Walter |
| 3,671,689 | A | * | 6/1972 | Flavo ..... 200/48 A |
| 4,031,346 | A | | 6/1977 | Bridges |
| 4,556,863 | A | | 12/1985 | Devitt |
| 4,681,990 | A | * | 7/1987 | Osborne ..... 200/48 KB |
| 4,707,574 | A | | 11/1987 | Smith |
| 5,091,616 | A | | 2/1992 | Ramos |
| 5,268,543 | A | | 12/1993 | Ramos |
| 5,451,730 | A | | 9/1995 | Phillips, Sr. |
| 5,821,486 | A | | 10/1998 | Paw et al. |
| 5,823,321 | A | | 10/1998 | Leclerc |
| 6,459,053 | B1 | | 10/2002 | Roberts |
| 6,541,717 | B1 | * | 4/2003 | Roberts ..... 200/43.11 |

* cited by examiner

*Primary Examiner*—Elvin Enad
*Assistant Examiner*—M. Fishman
(74) *Attorney, Agent, or Firm*—Marcus R. Mickney; Alfred N. Goodman; Mark S. Bicks

(57) ABSTRACT

A resistance assembly having a resistance member prevents accidental movement of a hookstick operated switching assembly. A switch assembly of the hookstick operated switching assembly is mounted on a base. The resistance member includes a lever connected to the switch assembly that moves the switch between opened and closed positions. A first end of a pin is connected to the lever. A resistance member is connected to a second end of the pin. The resistance member contacts the base when the lever rotates to move the switch assembly between open and closed positions, thereby preventing accidental opening and closing of the switch assembly.

24 Claims, 7 Drawing Sheets

RESISTANCE ASSEMBLY FOR HOOKSTICK OPERATED SWITCHING ASSEMBLY

CROSS-REFERENCE TO RELATED APPLICATION

This application claims the benefit under 35 U.S.C. § 119(e) of provisional patent application Ser. No. 60/432,646, filed Dec. 12, 2002, which is hereby incorporated by reference in its entirety.

FIELD OF THE INVENTION

The present invention relates to a resistance assembly for a hookstick operated switching assembly. More particularly, the present invention relates to a resistance member that prevents accidental closing of the switch blades of the hookstick operated switching assembly when the switch blades are in the open position. Still more particularly, the present invention relates to a pin and roller assembly that contacts a base of the hookstick operated switching assembly to resist movement of the switches from open to closed position until sufficient force is exerted to overcome the resistance.

BACKGROUND OF THE INVENTION

Overhead electric power distribution lines are supported on utility poles that may be 40–50 feet high. Horizontal supports mounted to the pole often carry various distribution apparatus. Because such distribution lines commonly operate in a three-phase system with three lines mechanically connected to the horizontal support and electrically insulated from each other, three associated lines ordinarily must be switched and reconnected simultaneously for maintenance or rerouting of power. This simultaneous switching process requires some form of group operated switch system.

Currently, many high voltage switch assemblies for overhead power distribution lines are open and closed by a field technician using a hookstick. The hookstick engages an operating lever connected to a universal control section securely connected to the rotatable switch phase bearing. Rotation of the bearing is translated into lateral displacement of an interphase shaft along the horizontal support beam. Conductive switch blades on each switch phase connection may be rotated into or out of electrical connection with the respective phase line. Pulling a hook on the operating lever with the hookstick rotates the control shaft, which rotates the switch blades into either closed or open positions.

High voltage overhead power switches are typically mounted well above ground and experience a variety of externally applied forces, such as weather, wild animals, vandalism, utility pole deformation, and vibration, which may cause a switch blade to move or close unintentionally. Furthermore, if a switch blade moves close enough to a contact, flashover may occur. The operating lever must maintain the security required to prevent unintended closing, opening or movement of the conductive blades. Therefore, a need exists for an overhead switch assembly having a resistance assembly to prevent accidental closing, opening or movement of the switch blades.

Accidental closing of a switch blade may cause equipment damage, loss of electrical service and personnel injury. Therefore, a need exists for a resistance assembly to secure a switch assembly in an open position. A further need exists for a resistance assembly for high voltage three phase distribution systems that provides resistance forces to maintain the switchblades in an opened or closed position despite ambient wind, weather, and vibration.

Existing switch assemblies generally require positive measures to be taken to ensure that the switch assembly is locked and prevented from operating. U.S. Pat. No. 5,451,730 to Phillips, Sr.; U.S Pat. No. 5,467,622 to Becker et al.; and U.S. Pat. No. 5,260,528 to Benda disclose switch assemblies in which an operator must manually lock the switch in an open or closed position. Thus, a need exists for a resistance assembly that secures a switch assembly in an open or closed position without requiring the operator to manually lock the switch assembly in that position.

A need exists for an improved resistance assembly to secure a switch assembly in an open or closed position.

SUMMARY OF THE INVENTION

Accordingly, it is a primary objective of the present invention to provide an improved hookstick operated switch assembly.

A further objective of the present invention is to provide a resistance assembly to prevent accidental movement of the switch blades of the hookstick operated switch assembly.

A still further objective of the present invention is to provide a resistance member that prevents accidental closing of the switch blades of the hookstick operated switch assembly when in the opened position.

The foregoing objects are basically attained by providing a resistance assembly having a resistance member to prevent accidental movement of a hookstick operated switching assembly. A switch of the hookstick operated switching assembly is mounted on a base. The resistance member includes a lever connected to the switch to move the switch between opened and closed positions. A first end of a pin is connected to the lever. A roller is connected to a second end of the pin. The roller contacts the base when the lever rotates to move the switch between opened and closed positions, thereby preventing accidental opening and closing of the switch.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now the drawings that form a part of the original disclosure.

DETAILED DESCRIPTION OF THE INVENTION

The present invention relates to a resistance assembly for a hookstick operated switching assembly 11 (FIG. 2), such as the group-operated switching assembly disclosed in U.S. Pat. No. 6,459,053 to Roberts and the hookstick operated switching assembly disclosed in U.S. Pat. No. 6,541,717 to Roberts, the subject matters of both are hereby incorporated by reference in their entirety.

Figure 2:
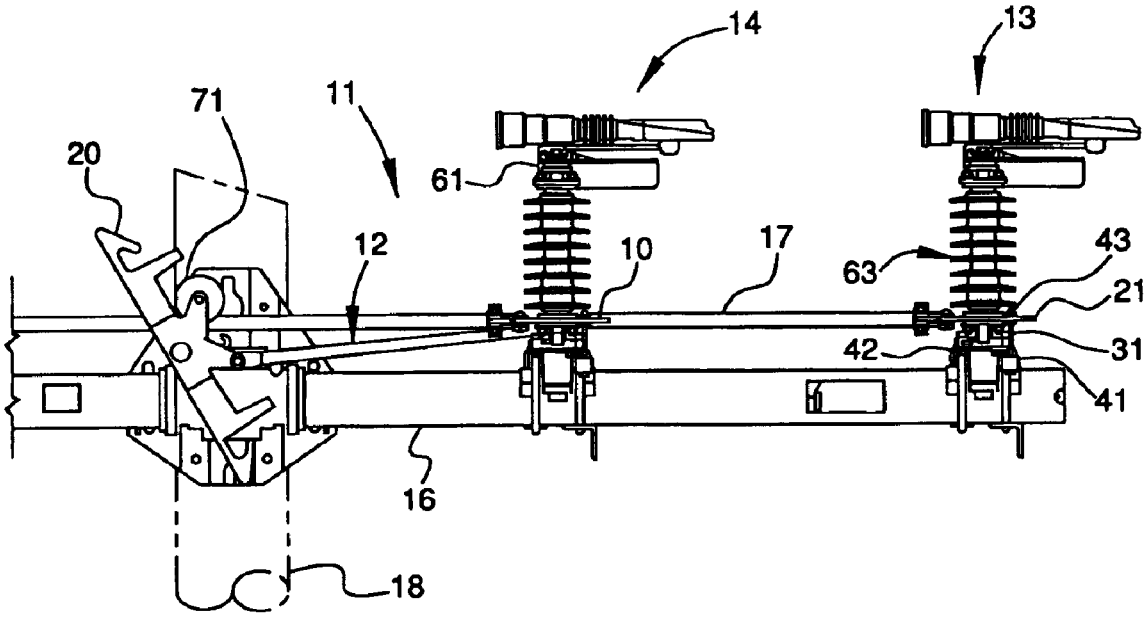
FIG. 2 is a front elevational view of a hookstick operated switch assembly in which one switch has the resistance assembly of the present invention.

Briefly described in the context of a three phase switch assembly, the present hookstick operated switching assembly 11 is made of three modular switch assemblies, two switch assemblies 13 and 14 being shown in FIG. 2. The switch assemblies are operated simultaneously by displacement of a rigid interphase shaft 17. The interphase shaft 17 is initially urged to move by pivotal, rigid linkages through at least one of the switch phase levers on a switch assembly 14 that is, in turn, pivotally and rigidly linked to an hookstick lever 20 that rotates between a closed position (FIG. 2) and an open position.

Although the invention is described in connection with a three phase high voltage distribution system using a horizontal support member and three vertically disposed switches supported thereon (a "horizontal" configuration), the invention is equally applicable to a wide variety of switch assembly orientations including a delta configuration (two switches on a horizontal support with a middle switch on the pole at a higher elevation), a vertical configuration (switches extend horizontally and perpendicularly to a horizontal support with switches moving in a vertical plane), and phase-over-phase configurations (switches extend horizontally and perpendicularly to a vertical utility pole at different elevations), as well as single phase systems.

Figure 3:
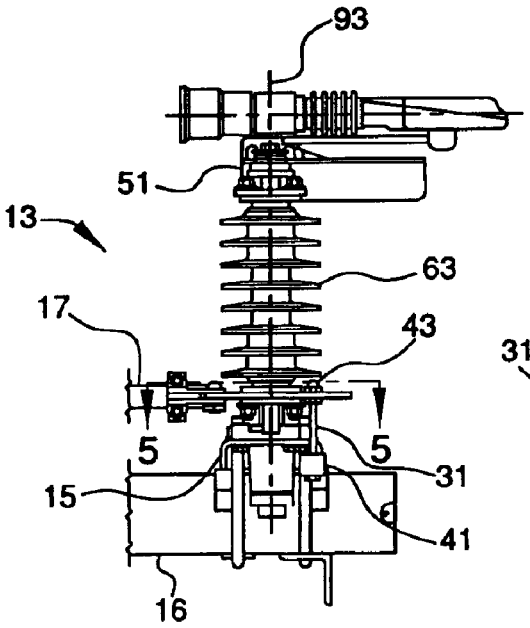
FIG. 3 is a front elevational view of the switch assembly of FIG. 1 in the closed position.
Figure 4:
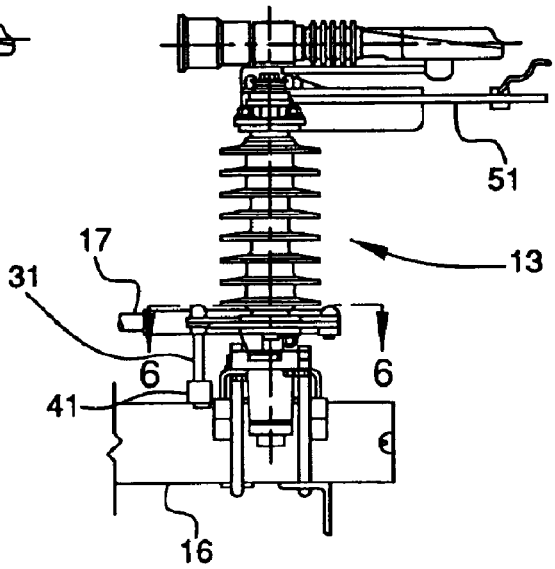
FIG. 4 is a front elevational view of the switch assembly of FIG. 1 in the opened position.

As shown in FIG. 2, drive switch phase 14 and a plurality of switch phases 13 are mounted to and supported on support crossarm 16 secured at an upper end of a vertical pole 18, such as a utility pole. Preferably, support crossarm 16 is positioned horizontally and made of a weather resistant, dimensionally stable, structural material. A hookstick engages the hookstick lever 20. Rotating hookstick lever 20 results in movement of drive lever 12, which rotates drive switch operating lever 10. Rotation of the drive switch operating lever 10 results in lateral movement of the interphase shaft 17, which simultaneously turns switch assemblies 13 and 14 between open and closed positions, as shown in FIGS. 4 and 3, respectively.

The present invention includes a resistance assembly 22 to prevent closing of a hookstick operated switching assembly 11, as shown in FIGS. 1–15. One of switch phases 13 of the hookstick operated switching assembly is mounted on a base 15. The resistance assembly comprises a switch operating lever 21 connected to the switch 13 to move the switch between opened and closed positions, as shown in FIGS. 4 and 3, respectively. A first end 33 of a pin 31 is connected to the lever 21. A resistance member 41 is connected to a second end 35 of the pin 31. The resistance member 41 contacts the base 15 when the lever 21 rotates to move the switch 13 from the opened position to the closed position, thereby preventing accidental closing of the switch.

A first end of the drive lever 12 is connected to the hookstick lever 20. A second end of the drive lever 12 is connected to a first end of the drive switch operating lever 10. A second end of the drive switch operating lever 10 is connected to the interphase shaft 17. Drive switch assembly 14 is secured to drive switch operating lever 10 so that rotation of the drive switch operating lever 10 also rotates switch blade 61 either into or out of engagement with a corresponding stationary contact. Thus, lateral movement of the interphase shaft 17 simultaneously opens and closes the switch assemblies 13, 14 connected to the interphase shaft, thereby rotating the switch blades relative to stationary contacts.

Preferably, a stationary contact includes an interrupter that reduces or eliminates arcing as a switch blade 51 is moved from or into the stationary contact. Preferably, each switch assembly has an interrupter.

Figure 6:
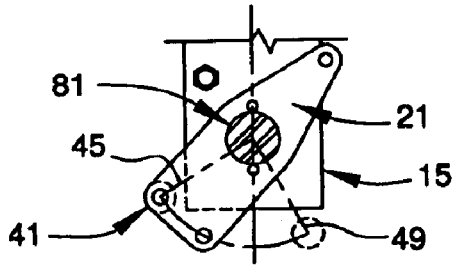
FIG. 6 is a top plan view of the switch operating lever showing the resistance assembly in a fully opened position.

Preferably, the resistance assembly 22 for a hookstick operated switching assembly 11 prevents accidental closing of the switch blades 51 when in the open position, as shown in FIGS. 4 and 6. An overtoggle assembly may be used to prevent accidental opening of the switch blades when in the closed position, as described in the aforementioned U.S. Pat. No. 6,459,053 to Roberts. However, the roles of the resistance assembly 22 and the overtoggle assembly may be reversed such that the resistance assembly prevents accidental opening and the overtoggle assembly prevents accidental closing of the switch blades. Alternatively, the resistance and overtoggle assemblies may be combined to prevent either accidental opening or closing of the switch blades.

First end 33 of a rigid pin 31 is attached to the switch rotating lever 21 that is connected to the interphase shaft 17. Preferably, the pin 31 is made of a rigid, inflexible material. A fastener 43 may be used to secure the rigid pin 31 to the lever 21. A resistance member 41 is attached to a second end 35 of the rigid pin 31. Preferably, the resistance member 41 is a rigid roller. Preferably, the resistance member 41 is made of a rigid, inflexible material, such as a thermoplastic material, e.g., such as delrin. Upon both opening and closing of the switch assembly 13, the resistance member 41 contacts a corner 42 of the U-shaped switch base 15, which resists further movement of the resistance member 41, thereby preventing the switch assembly 13 from opening or closing. Furthermore, since the switch operating lever 21 is connected to the interphase shaft 17, all other switch assemblies connected to the interphase shaft are likewise prevented from opening or closing.

Figure 1:
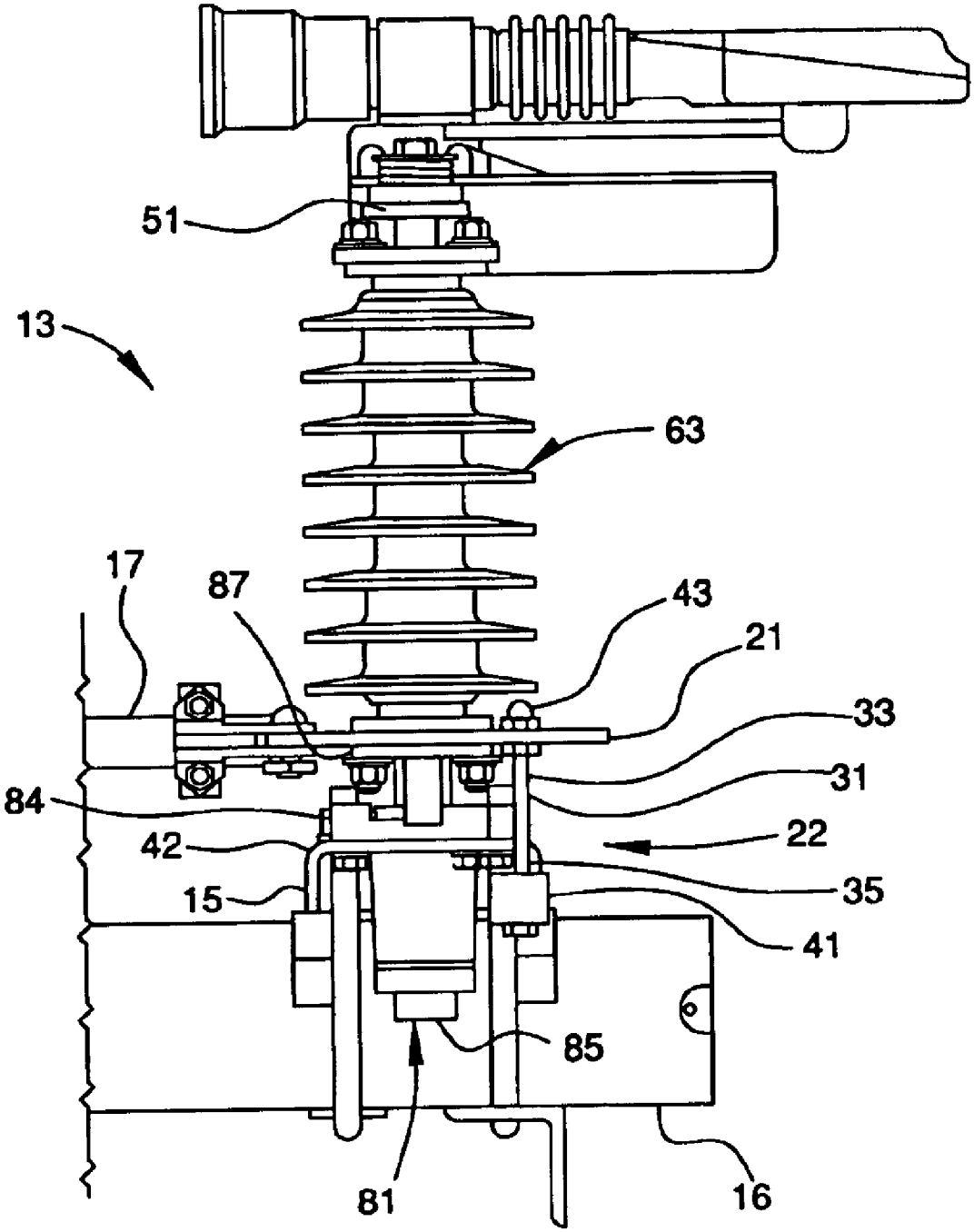
FIG. 1 is a front elevational view of a switch assembly having a resistance assembly according to the present invention.
Figure 8:
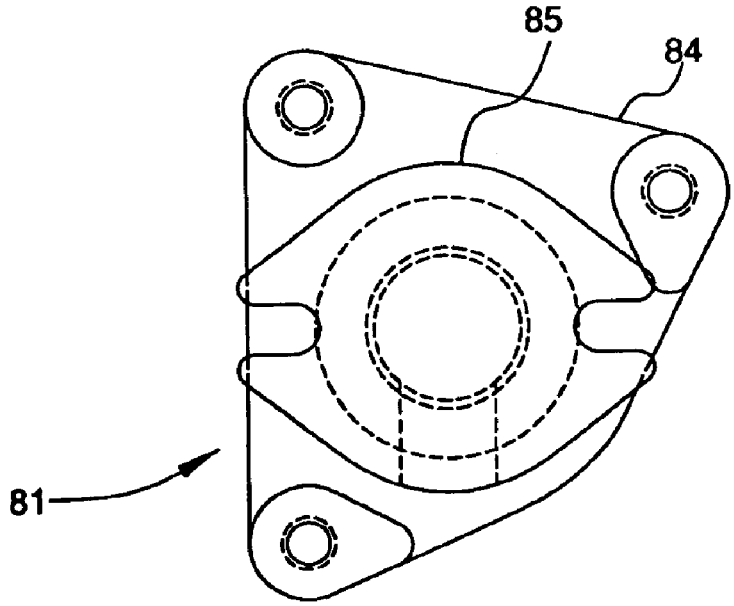
FIG. 8 is a top plan view of the bearing assembly.
Figure 9:
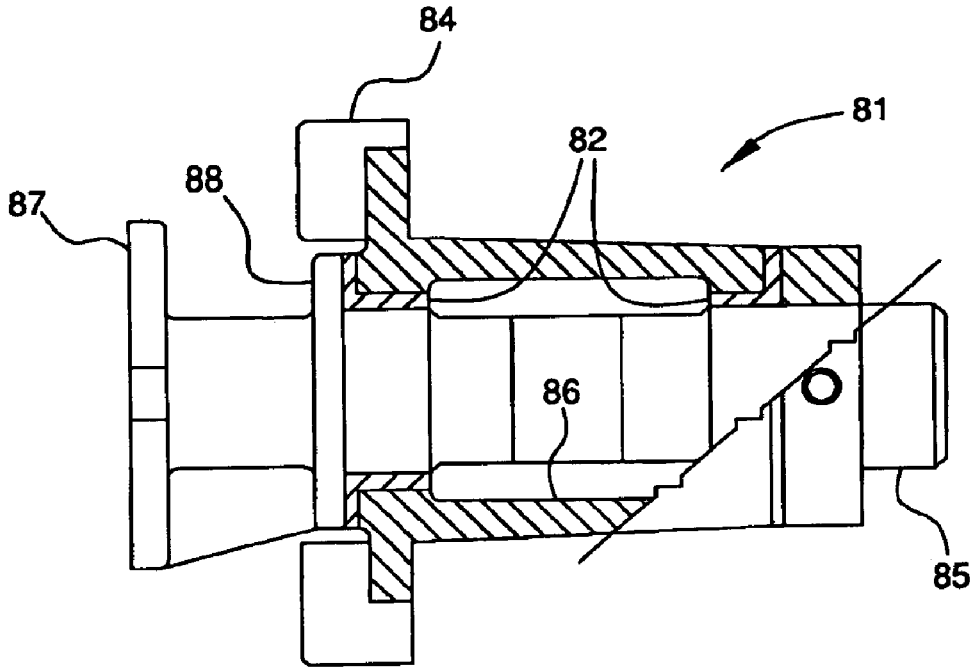
FIG. 9 is a side elevational view partially in section of the bearing assembly of FIG. 8.
Figure 10:
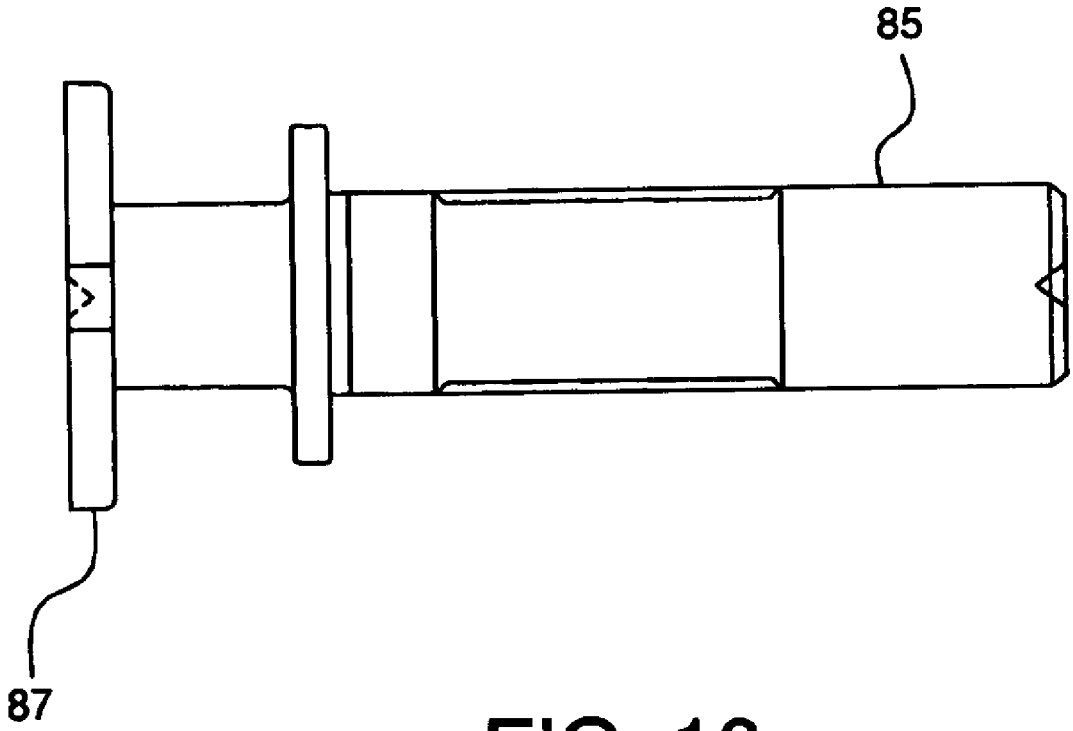
FIG. 10 is a front elevational view of the shaft of the bearing assembly.
Figure 11:
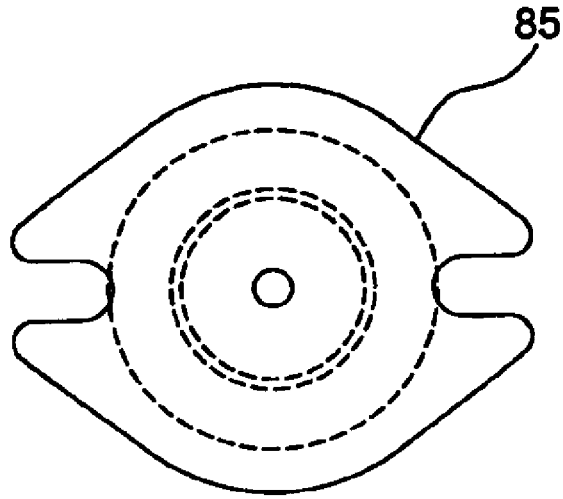
FIG. 11 is top plan view of the shaft of the bearing assembly of FIG. 10.
Figure 12:
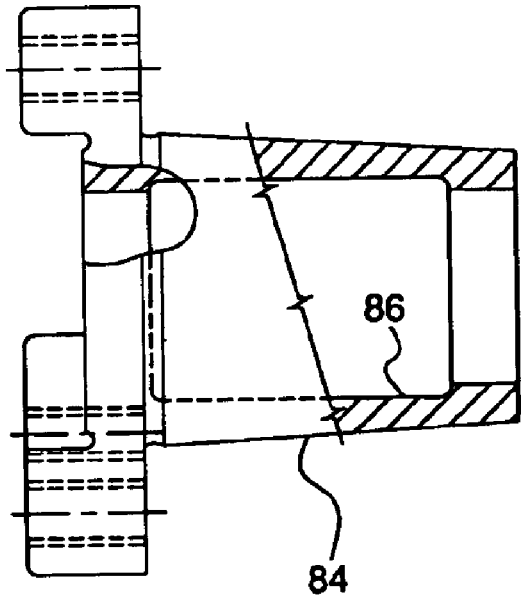
FIG. 12 is a front elevational view partially in section of the housing of the bearing assembly.
Figure 13:
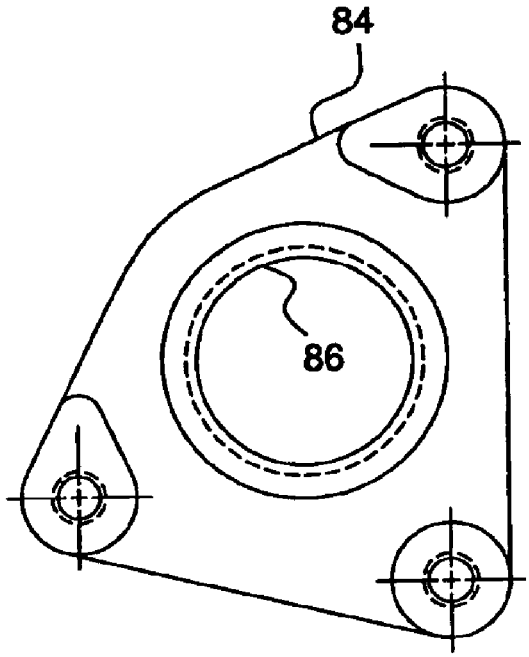
FIG. 13 is a top plan view of the housing of the bearing assembly of FIG. 12.
Figure 14:
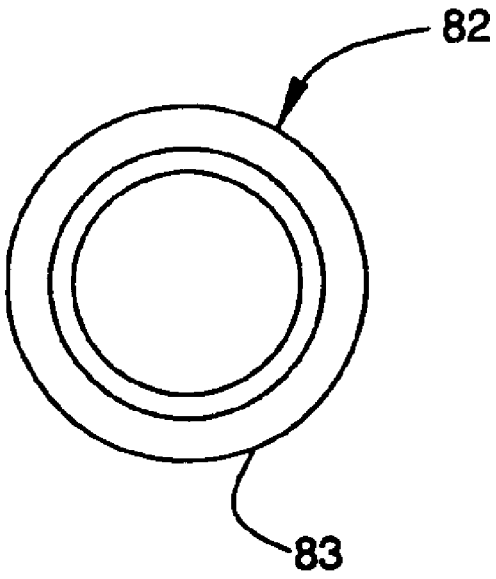
FIG. 14 is a top plan view of the bearing of the bearing assembly.
Figure 15:
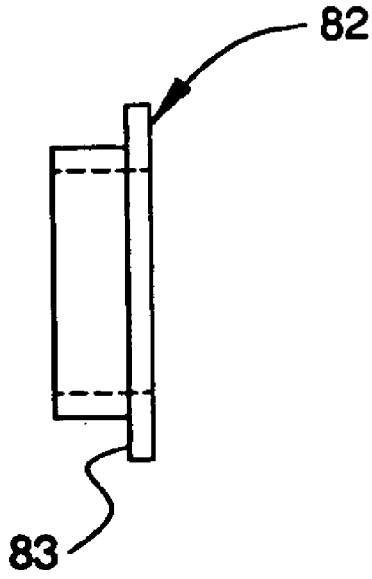
FIG. 15 is a front elevational view of the bearing of the bearing assembly of FIG. 14.

Applying sufficient force to the operating linkage, including hookstick lever 20, drive lever 12, interphase shaft 17 and operating lever 21, causes slight movement of the switch insulator bearing assembly 81 due to its internal resiliency, as shown in FIGS. 8 and 9. The bearing assembly 81 connects the switch operating lever 21 to the switch insulator 63 (FIG. 1). The slight radial movement in the bearing assembly 81 results in lateral movement of the switch rotating lever 21, thereby resulting in lateral movement of the rigid pin 31 and resistance member 41. The lateral movement of the pin 31 and resistance member 41 allows the resistance member to clear the corner 42 of the switch base 15 during the opening and closing of the switch blade 51 by the operating linkage. By impeding the movement of the resistance member 41 when in the open position (FIG. 4) without sufficient force being applied to overcome the internal resilient forces of the bearing assembly 81 resisting lateral movement, the rigid pin 31 and resistance member 41 prevent accidental closure of the hookstick operating switching assembly 11.

Bearing assembly 81 is shown in FIGS. 8–15. Bearings 82 (FIGS. 14 and 15) are positioned at opposite ends of the housing 84 of the bearing assembly 81. Bearing shoulders 83 are positioned adjacent the ends of the housing. The housing 84 mounts the switch assembly 13 to the base 15, as shown in FIG. 1.

Shaft 85 is positioned within internal passageway 86 of the housing 84. An end 87 of the shaft 85 is rotatably secured to the insulator 63 with the switch operating lever 21 secured therebetween, as shown in FIG. 1. A flange 88 on the shaft 85 is rotatably secured to a bearing 82 of the bearing assembly 81. Thus, the switch operating lever 21 rotates both the shaft 85 and a rod disposed within the outer molded skirts of the insulator 63 around axis of rotation 93 (FIG. 3).

Figure 5:
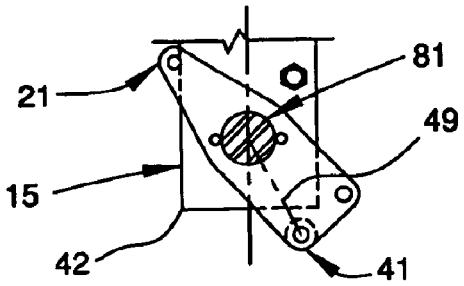
FIG. 5 is a top plan view of the switch operating lever showing the resistance assembly in a fully closed position.
Figure 7:
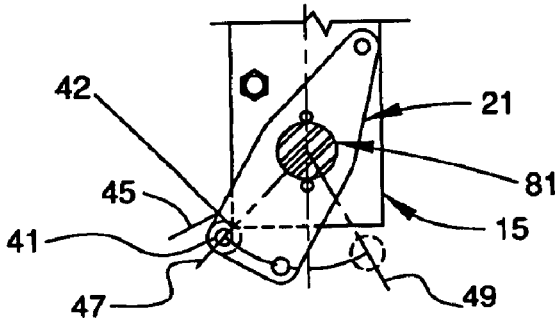
FIG. 7 is a top plan view of the switch operating lever showing the resistance assembly in an interference position.

Tolerances in the bearing assembly 81 and in the bearings 82 themselves allow for lateral movement of the operating lever 21 when sufficient force is applied to the operating linkage. The lateral movement shown between FIGS. 6 and 7 is substantially perpendicular to the axis of rotation 93 (FIG. 3). Thus, the rigid pin 31 and resistance member 41 may be moved from the interference position shown in FIG. 6 to the closed position shown in FIG. 5 to fully close the switch assembly. Tolerances exist between the housing 84 and the bearings 82 and between the shaft 85 and the bearings 82, as shown in FIG. 9. Furthermore, the bearings 82 may add slight lateral movement to the operating lever 21 by flexing during operation. Preferably, the bearings 82 are made of a flexible material that flexes more than a harder metal under high pressure, such as that experienced during operation of the switch assembly. These tolerances and the bearing material provide for slight lateral movement of the operating lever 21 so that the rigid pin 31 and resistance member 41 may be moved from the interference position (FIG. 6) to the closed position (FIG. 5).

The operating lever 21 of the switch assembly 13 is shown in the fully opened position in FIG. 6. If the operating lever 21 is rotated, the resistance member 41 strikes the corner 42 of the base 15, as shown in FIG. 7. Line 45 indicates the fully opened position of the resistance member 41. Line 47 indicates the position of the resistance member 41 when it contacts the corner 42 of the base 15 and is prevented from further rotational movement. As shown in FIG. 6, line 49 indicates the position of the roller member 41 when in the fully closed position after the resistance member has been manually moved around the corner 42 of the base 15.

Preferably, the operating lever 21 rotates approximately ten degrees from the fully opened position toward the closed position before the resistance member 41 contacts the corner 42 of the base 15 and is prevented from further rotation, i.e., the angle between line 45 and line 47 is approximately 10 degrees. The interference of the base 15 with the rotation of the switch operating lever 21, as shown in FIG. 7, provides a gap between the blade 51 and the contact to prevent electrical flashover. To completely close the switch assembly 13, the interference between the base 15 and the resistance member 41 must be overcome. A combination of the play and the parts tolerances in the rotating bearing assembly 81 allow for slight lateral movement of the switch operating lever 21 to allow the resistance member 41 to clear the base 15 and to close the switch assembly, as shown in FIGS. 3 and 5.

A counterweight 71 further assists in maintaining the switch assemblies of the hookstick operated switch assembly 11 in the open position, as shown in FIG. 2. When the switches are in the open position, the hookstick lever 20 has been rotated counterclockwise such that the left end of the lever is at its lowermost position. Therefore, the counterweight 71 is also at its lowest position. To close the switch assemblies requires rotating the hookstick lever 20 clockwise and lifting the counterweight 71. Therefore, gravity must be overcome in order to close the switch assemblies 13 and 14. Thus, gravity, i.e., overcoming the mass of the counterweight 71, further prevents the switch assemblies from accidentally closing when a counterweight is used in addition to the resistance assembly 22.

While advantageous embodiments have been chosen to illustrate the invention, it will be understood by those skilled in the art that various changes and modifications may be made therein without departing from the scope of the invention as defined in the appended claims.

What is claimed is:

1. A resistance assembly, comprising:

a rigid base;

a switch assembly mounted on said base;

a lever connected to said switch assembly to move said switch assembly between opened and closed positions;

a pin having first and second ends, said first end being connected to said lever;

a resistance member connected to said second end of said pin, said resistance member contacting said base when said lever rotates to move said switch assembly between open or closed positions, thereby preventing accidental movement of said switch assembly; and a bearing assembly connected between said lever and said switch assembly, said bearing assembly capable of being moved radially relative to an axis of rotation thereof to move said pin laterally to allow said roller to avoid said base to open or close said switch assembly.

2. A resistance assembly according to claim 1, wherein said bearing assembly is made of a flexible material.

3. A resistance assembly according to claim 1, wherein said base is substantially U-shaped.

4. A resistance assembly according to claim 3, wherein a first leg of said U-shaped base prevents movement of said resistance member thereby.

5. A resistance assembly according to claim 1, wherein said resistance member is a roller.

6. A resistance assembly according to claim 1, wherein said pin is made of a rigid, inflexible material.

7. A resistance assembly according to claim 1, wherein said resistance member is made of a thermoplastic material.

8. A resistance assembly according to claim 7, wherein said thermoplastic material is delrin.

9. A group-operated hookstick switch assembly, comprising:

a support;

at least one switch assembly mounted on a base that is secured to said support;

a lever connected to said at least one switch assembly to move said at least one switch assembly between opened and closed positions;

a shaft connecting each said lever, said shaft rotating each said levers to move said at least one switch assembly between opened and closed positions;

a pin having first and second ends, said first end being connected to one of said levers;

a resistance member connected to said second end of said pin, said resistance member contacting said base when said lever rotates to move said at least one switch assembly between open or closed positions, thereby preventing accidental movement of said at least one switch assembly.

10. A group-operated hookstick switch assembly according to claim 9, wherein a bearing assembly connected between said lever and said at least one switch assembly to which said resistance member is connected, said bearing assembly capable of being moved radially relative to an axis of rotation thereof to move said pin laterally to allow said roller to avoid said base to open or close said at least one switch assembly.

11. A group-operated hookstick switch assembly according to claim 9, wherein said base is substantially U-shaped.

12. A group-operated hookstick switch assembly according to claim 11, wherein a first leg of said U-shaped base prevents movement of said resistance member thereby.

13. A group-operated hookstick switch assembly according to claim 9, wherein said resistance member is a roller.

14. A group-operated hookstick switch assembly according to claim 9, wherein said pin is made of a rigid, inflexible material.

15. A group-operated hookstick switch assembly according to claim 9, wherein said resistance member is made of a thermoplastic material.

16. A group-operated hookstick switch assembly according to claim 15, wherein said thermoplastic material is delrin.

17. A group-operated hookstick switch assembly according to claim 9, wherein a hookstick lever is connected to said shaft.

18. A group-operated hookstick switch assembly according to claim 17, wherein a weight is secured to said hookstick lever to prevent accidental movement of said hookstick lever.

19. A group-operated hookstick switch assembly according to claim 10, wherein said bearing assembly is made of a flexible material.

20. A resistance assembly, comprising:

a substantially U-shaped rigid base;

a switch assembly mounted on said base;

a lever connected to said switch assembly to move said switch assembly between opened and closed positions;

a pin having first and second ends, said first end being connected to said lever;

a resistance member connected to said second end of said pin, said resistance member contacting a first leg of said base when said lever rotates to move said switch assembly between open or closed positions, thereby preventing accidental movement of said switch assembly.

21. A resistance assembly according to claim 20, wherein said resistance member is a roller.

22. A resistance assembly according to claim 20, wherein said pin is made of a rigid, inflexible material.

23. A resistance assembly according to claim 20, wherein said resistance member is made of a thermoplastic material.

24. A resistance assembly according to claim 23, wherein said thermoplastic material is delrin.

* * * * *